United States Patent [19]

Marotta

[11] Patent Number: 4,603,714

[45] Date of Patent: Aug. 5, 1986

[54] TONER BOTTLE FOR COPIER/PRINTING MACHINES

[75] Inventor: Joseph J. Marotta, Webster, N.Y.

[73] Assignee: Xerox Corporation, Stamford, Conn.

[21] Appl. No.: 712,931

[22] Filed: Mar. 18, 1985

[51] Int. Cl.[4] ..... B65B 1/06

[52] U.S. Cl. ..... 141/383; 141/384; 251/149

[58] Field of Search ..... 141/1, 320, 346, 349, 141/364, 383, 384; 251/149

[56] References Cited

U.S. PATENT DOCUMENTS

| | | | |
|---|---|---|---|
| 1,226,722 | 5/1917 | Sullivan | 141/346 |
| 4,060,105 | 11/1977 | Feldeisen et al. | 141/1 |
| 4,271,011 | 6/1981 | Spencer et al. | 209/236 |
| 4,304,273 | 12/1981 | Caudill et al. | 141/268 |
| 4,538,653 | 9/1985 | Shea et al. | 251/149 X |

FOREIGN PATENT DOCUMENTS 211494 10/1960 Austria .

0032986 5/1981 European Pat. Off. .

OTHER PUBLICATIONS

Alan Shanly; Xerox Disclosure Journal; Jan./Feb. 1979; vol. 4, p. 83.

*Primary Examiner*—Stephen Marcus
*Assistant Examiner*—Mark Thronson
*Attorney, Agent, or Firm*—Frederick E. McMullen

[57] ABSTRACT

A toner bottle for resupplying toner to a copying or reproduction machine having an iris type closure in the bottle mouth to control discharge of toner therefrom and prevent spilling, the iris closure consisting of a first iris member located in the bottle mouth with a second cooperating iris closure integral with a cover for the bottle, projecting tabs on the first and second iris members cooperating with the machine toner hopper to establish relative rotation between the first and second iris members on rotation of the bottle while locking the bottle in place on the machine.

7 Claims, 11 Drawing Figures

TONER BOTTLE FOR COPIER/PRINTING MACHINES

The invention relates to electrostatic copying and printing machines, and more particularly to an improved toner bottle for supplying toner to the developing system of such machines.

In electrostatic type copying and printing machines, latent electrostatic images are created on the charged photoconductive recording member of the machine which are developed by bringing a suitable developer, which comprises a mixture of carrier and toner particles, into developing relation with the latent images. Following developing, the images are transferred to a suitable copy substrate such as a copy sheet which is then fused to provide a permanent copy. The surface of the recording member is cleaned to remove any residual toner following which the recording member is charged.

In the foregoing developing process, the toner portion of the developer is consumed and therefore requires replenishment from time to time. Normally, adding fresh toner to the machine developing system is a machine operator or user function rather than that of the machine Tech Rep, and typically requires the operator to remove or open one or more of the machine exterior covers to gain access to the machine developing system. Following this, the toner supply opening in the machine developer housing is opened and the desired amount of fresh toner added. Following this, the toner supply opening is closed and the machine restored to an operating state.

Typically, make-up toner is supplied by the machine manufacturer and others in containers or bottles, and in theory all that is required to add toner is that the bottle be opened and the contents, or as much as is needed, be funneled into the developer housing. However, as well known to those skilled in the art, toner comes in the form of a very fine powder or dust which, because of its pigmented nature, is very dirty and susceptible to leaking or spilling and tends, on coming into contact with any soft or absorbent object such as clothes, to stick and smear. Further, because of the extremely small size and weight of the individual toner particles, the particles are readily borne and carried about by even the slightest of air currents, and consequently, when spilled or lost during the toner adding procedure tend to get on and contaminate everything in the vicinity. As a result, adding fresh toner to a reproduction or copying machine is usually a difficult and ofttimes dirty job.

While various ways of supplying toner to reproduction and copying machines have been suggested to overcome the difficulty in handling and dispensing of toner without spilling and leakage, the problem of handling toner when adding toner to a machine remains a very serious concern. In some cases, the toner container or bottle is relatively large and heavy and hence difficult for the operator to handle and grasp. In others, the toner bottle must be opened, or at least partially opened, prior to inserting the bottle into a discharge position which enhances the tendency of the toner to spill or leak. In other cases, a tear away strip is employed with the toner bottle which is to be removed either just prior to or subsequent to disposition of the toner bottle in place over the access opening in the developer system. While the latter arrangement for example is of help, the operator is still left with the job of disposing of the tear away strip which may itself be contaminated with toner as well as with the difficult if not impossible chore of trying to reseal the toner bottle with the user tear away strip in the event only a portion of the toner in the bottle is dispensed.

The invention relates to a toner bottle of the type which fits over the toner inlet in the developer housing of a copier/printing machine to add toner to the machine without spilling or loss, comprising, in combination: a container for the toner, the container having a toner discharge opening at one end; and a cover for the container one end, the cover including a first iris member having at least one aperture therethrough for assembly with the container so as to close the container toner discharge opening except for the aperture, the first iris member having at least one control tab projecting outwardly therefrom; and a second iris member having an aperture therethrough corresponding to each aperture in the first iris member, the first and second iris members cooperating with one another to form an iris adapted on predetermined relative rotation between the first and second iris members to align the aperture in the first iris member with the corresponding aperture in the second iris member to enable toner to discharge through the apertures from said container, the apertures when not aligned closing the container toner discharge opening; the second iris member being sized to fit over the container one end to trap the first iris member therebetween and form the cover with the iris; the second iris member having a control slot for each of the first iris member control tabs, the control slot having a predetermined length whereby to establish the predetermined relative rotation between the first and second iris members for movement of the iris between open and closed positions; the second iris member having at least one outwardly projecting locking tab whereby on assembly of the bottle with the housing and rotation of the bottle, the second iris member locking tab is moved into locking engagement with the developer housing to attach the bottle to the developer housing while the first iris member control tab is locked against movement to establish relative movement between the first and second iris members through a distance established by the control slot to bring the apertures in the first and second iris members into alignment with one another and discharge toner from the container into the developer housing.

IN THE DRAWINGS

Figure 10:
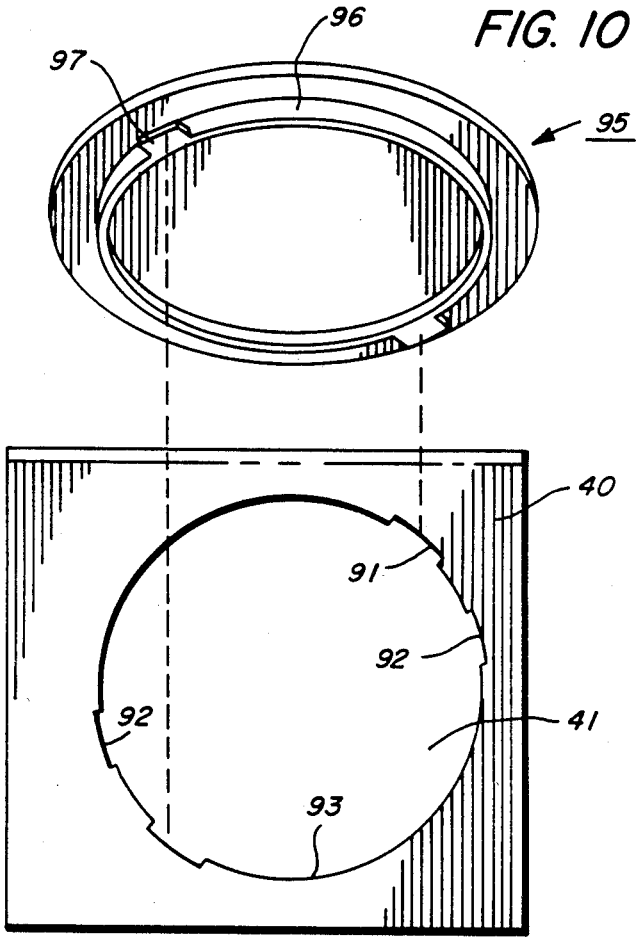
Figure 11:
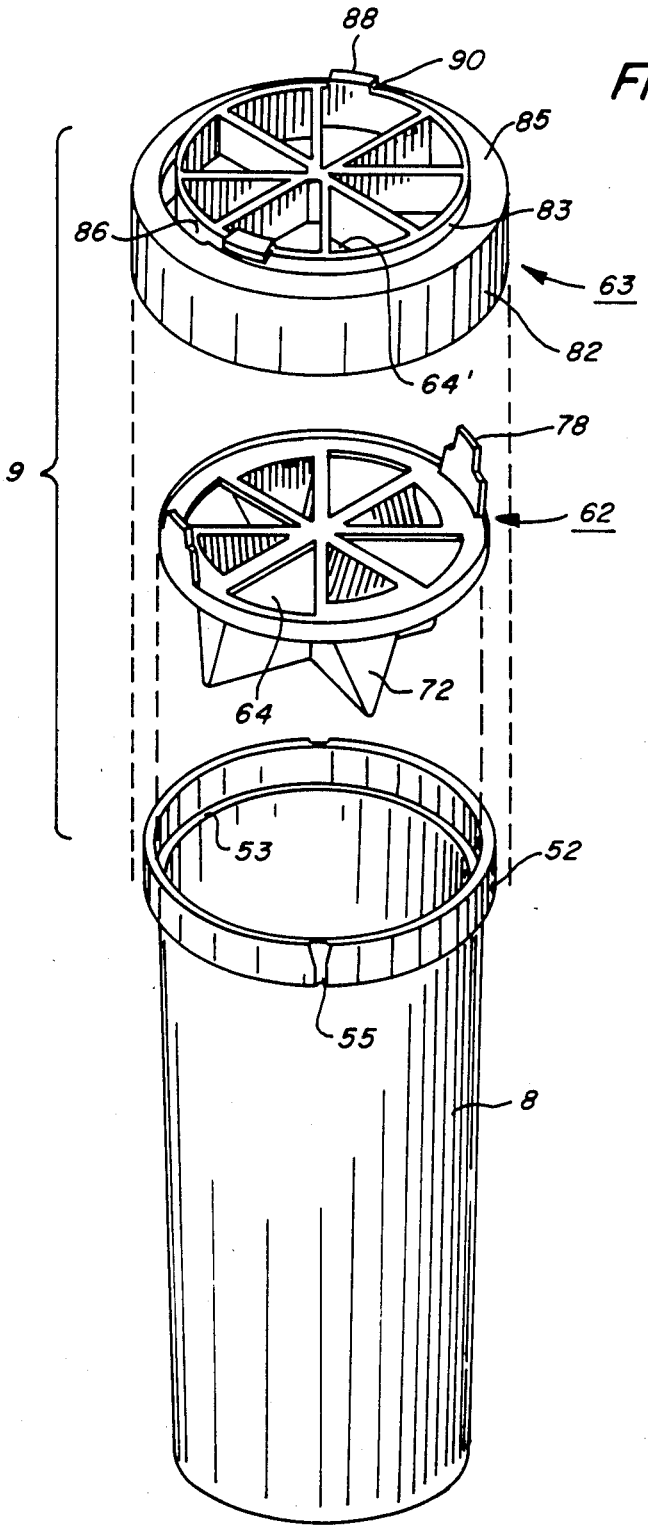

FIG. 10 is a partial isometric view showing details of the toner access opening in the developing system toner hopper together with a removable cap for closing the toner access opening when not adding toner; and FIG. 11 is an exploded isometric view depicting the toner cartridge and the cover first and second iris members in assembled relation to form the toner supply bottle of the present invention.

Referring to the drawings, there is shown a developing system, designated generally by the numeral 10, of a xerographic type copying or reproduction machine of the type with which the toner supply bottle 6 of the present invention is adapted to be used. As will appear, toner supply bottle 6 consists of a toner container 8 and cover 9. Developing system 10 includes a developer housing 12 having a sump 14 within which a developer mixture, typically composed of relatively larger carrier beads and relatively smaller ink particles or toner, resides. Developer housing 12 is suitably supported in predetermined operative relation with the machine photoconductive member, exemplified here by a drum 16 having a photoconductive surface 18. Drum 16 is rotated in the direction shown by the solid line arrow in FIG. 1 by suitable drive means (not shown).

As will be understood by those skilled in the xerographic arts, during operation of the copying or reproduction machine, the photoconductive surface 18 of drum 16 is uniformly charged and thereafter exposed to create a latent electrostatic image. The latent electrostatic image is thereafter carried on drum 16 past developing system 10 where the image is developed, with the developed image being thereafter transferred to a copy sheet brought forward from a suitable copy sheet supply in registered relation with the developed image. The unfused image is thereafter fixed or fused to provide a permanent copy. Following transfer, the photoconductive surface 18 of drum 16 is cleaned to remove any leftover developer materials preparatory to charging.

A magnetic brush type developing roll 20 is rotatably journaled in developer housing 12 in predetermined operative relation with the photoconductive surface 18 of drum 16, the axis of developing roll 20 being parallel to the the axis of rotation of drum 16. Developing roll 20 has an outer rotatable hollow sleeve or cylinder 26 of a suitable non-magnetic material such as aluminum having a stationary array of magnets 28 disposed therewithin, the polarity and angular disposition of magnets 28 being chosen to cause developer to be attracted to the surface of sleeve 26 and carried thereon into developing relation with the photoconductive surface 18 as will appear more fully.

A cylindrical paddle wheel 32 having a plurality of vanes or paddles 34 about the periphery is rotatably journaled in sides 22 of developer housing 12 below developing roll 20, the paths of rotation of sleeve 26 of developing roll 20 and paddle wheel 32 being in closely spaced relation with one another. The axis of paddle wheel 32 is parallel with the axis of drum 16 and developing roll 20. Paddle wheel 32 is located in developer housing 12 such that paddles 24 pass or sweep through sump 14 and the developer mixture therein to carry developer therefrom into proximity with sleeve 26 of developing roll 20, the magnetic force produced by magnets 28 attracting developer carried by paddles 34 to the outer surface of sleeve 26 to load developer onto the developing roll sleeve 26.

A bar-like wiper 36 is formed on developer housing 12 downstream of the point where developer is loaded onto developing roll sleeve 26, the leading edge of wiper 34 being in predetermined spaced relation with the surface of sleeve 26 to remove excess developer and provide a brush-like covering of developer of preset thickness on sleeve 26. Developing roll 20 and paddle wheel 32 are rotated by suitable means (not shown) in the direction shown by the solid line arrows in FIG. 1.

Following movement of the developer brush 37 created on the surface of sleeve 26 of developing roll 20 into operative relation with the photoconductive surface 18 of drum 16, the continued rotation of sleeve 26 carries the developer away from drum 16. As the developer supporting area of sleeve 26 comes opposite the point of no magnetic force, the developer falls by gravity back into sump 14. A suitable cross-mixing baffle 39 extends across the width of developer housing 12 in the path of the returning developer, baffle 39 serving to intermix the carrier and toner particles as they pass back into sump 14 to assure a uniform developer mixture.

Toner is supplied to developer housing 12 from a toner dispensing hopper 40 disposed on one side of developer housing 12. An auger type agitator (not shown) in the bottom of hopper 40 forces toner from hopper 40 into a hollow toner dispensing tube 45 extending transversely across the width of housing 12. Dispensing tube 45 has a succession of openings or apertures 47 along the length thereof which allow metered amounts of make-up toner to be discharged from tube 45 into sump 14. An auger 48 is provided in the interior of dispensing tube 45 for the purpose of distributing the toner transversely along the length of toner dispensing tube 45, auger 48 being rotated by suitable drive means (not shown) periodically on a demand for toner. A toner access opening 41 is provided in the top of toner hopper 40.

In the ensuing description, toner bottle 6 and the parts and assemblage thereof are considered to be in an upright position. When supplying toner to the toner hopper 40 of a developing system of the type described, toner supply bottle 6 is inverted to permit toner to fall by gravity into the toner hopper as will appear.

Figure 3:
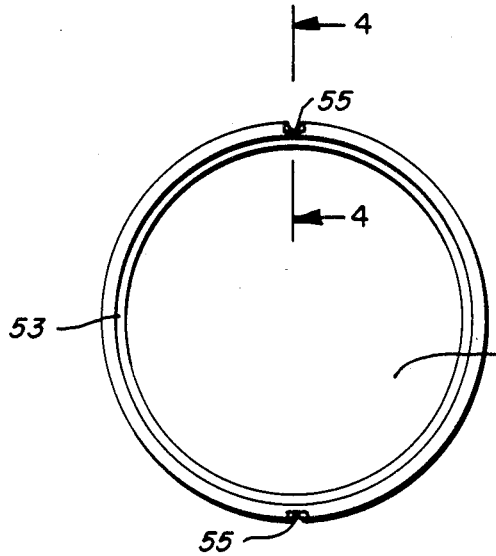
FIG. 3 is a top view of the toner container shown in FIG. 2.
Figure 2:
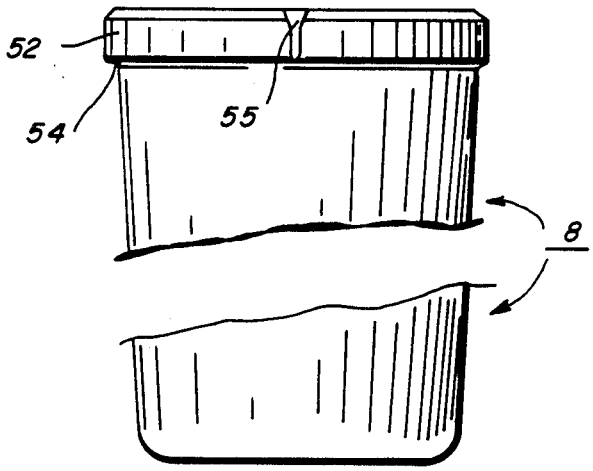
FIG. 2 is a side view of the toner container for the toner supply bottle shown in FIG. 1.
Figure 4:
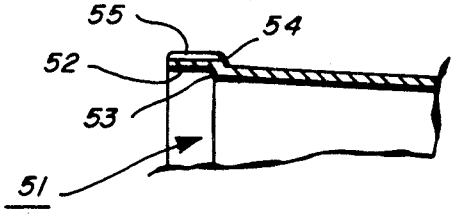
FIG. 4 is a partial side view in cross section taken along lines 4—4 of FIG. 3 showing details of the toner container mouth.
Figure 5:
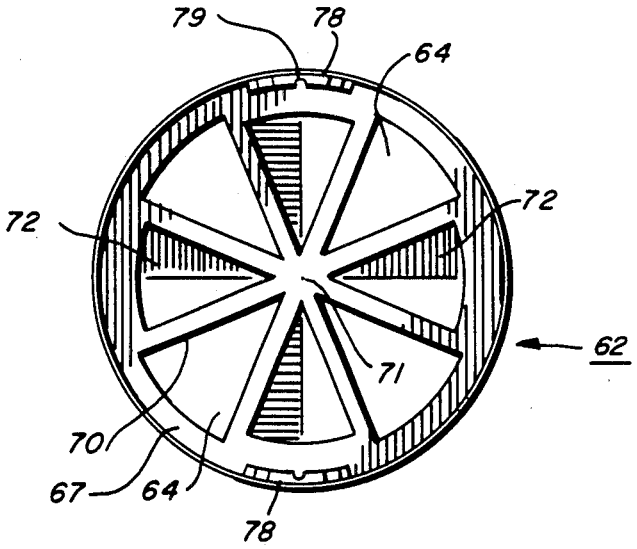
FIG. 5 is a top view of the first iris member that forms part of the cover for the toner cartridge shown in FIG. 2.
Figure 6:
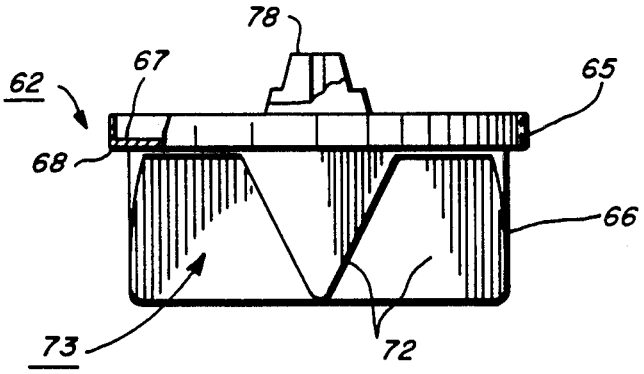
FIG. 6 is a side view in cross section of the iris member shown in FIG. 5.
Figure 9:
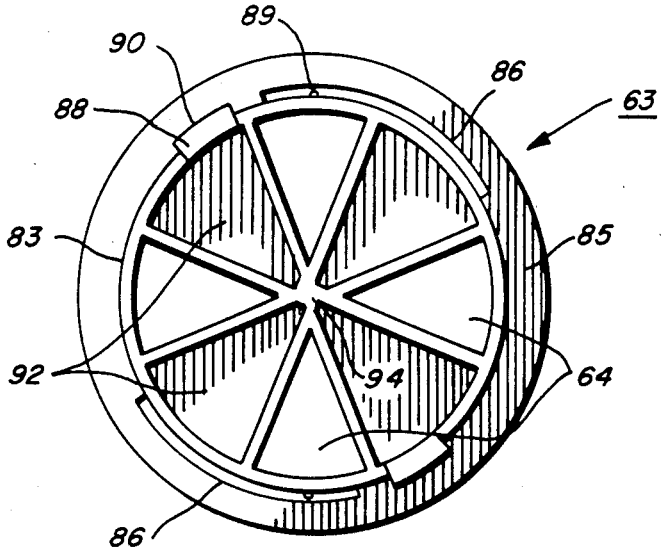
FIG. 9 is a top view of the iris member shown in FIG. 7.
Figure 8:
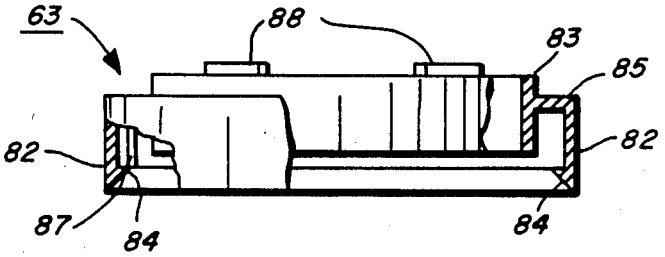
FIG. 8 is a side view in cross section of the iris member shown in FIG. 7.
Figure 7:
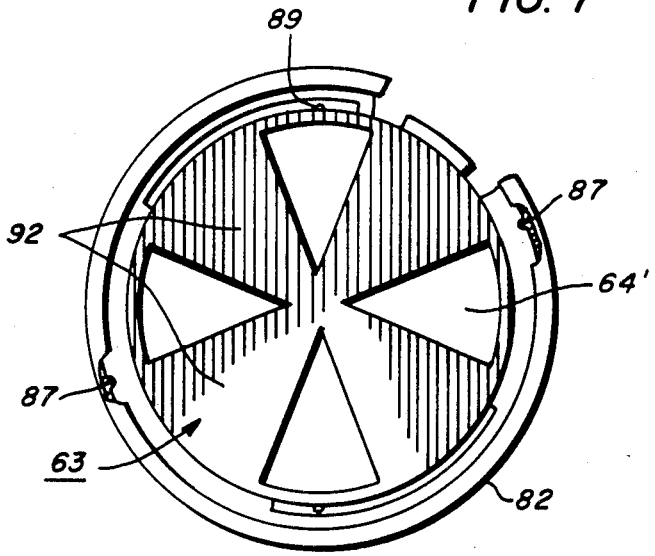
FIG. 7 is a bottom view of the second iris member that cooperates with the first iris member to form the cover for the toner container shown in FIG. 2.

Referring particularly to FIGS. 2–4 of the drawings, toner container 8 has a generally tapered cylindrical shape with an open end or mouth 51. An enlarged rim 52 at mouth 51 of toner container 8 forms an internal annular rim 53 and external locking surface 54. A pair of diametrically opposed vertical locking slots 55 are formed in the outside surface of the rim 52 of container 8, the uppermost portion of slots 55 being widened to facilitate insertion of locking tabs 78 of cover 9 when assembling cover 9 to toner container 8 as will appear.

Referring particularly to FIGS. 5–8 and 11, cover 9 incorporates an iris composed of cooperating disc-like first and second iris members 62, 63 for selectively opening and closing the toner container 8 as will appear more fully. When closed, the iris prevents leakage of toner from container 8 through cover 9 during handling, installation, and removal of the toner supply bottle 6 from the access opening 41 in toner supply hopper 40. On installation of the toner bottle 6 in position over the access opening 41, the iris is quickly and easily opened by grasping and rotating the toner container itself thereby enabling toner from container 8 to pass through toner opening 41 and into hopper 40 without removing cover 9.

First iris member 62, which inserts into the mouth 51 of the toner container 8, has an upper section 65 with an outer diameter slightly less than the inside diameter of container mouth 51. The outer diameter of lower section 66 of iris member 62 is reduced slightly and cooperates with upper section 65 to form generally circular upper and lower stop or locating surfaces 67, 68 respectively. Lower stop surface 68 rests against the internal annular rim 53 of container 8 to support and locate iris member 62 in container 8. Upper stop surface 67 is engaged by second iris member 63 when cover 9 is assembled as will appear. A pair of diametrically opposed control tabs 78 project from the upper stop surface 67 of iris member 62. Tabs 78 each have a line-like locking recess 79 on the interior surface thereof for locating first and second iris members in predetermined relative positions with respect to one another on assembly as will appear.

Iris member 62 has a plurality of evenly spaced spoke-like elements or seals 70 radiating from a central hub 71 to the sides thereof adjacent the upper portion thereof. The space between every other seal 70 is closed off by a downwardly depending triangular shaped section 72. The spaces between the remaining seals forms a series of spaced generally triangular shaped toner discharge apertures 64, with the downwardly depending sections 72 on each side forming a gradually narrowing conduit 73 to each aperture 64. Accordingly, on assembly of first iris member 62 with the toner container 8, sections 72 project inwardly toward the interior of container 8 and serve to facilitate flow of the toner toward and through apertures 64 without caking or clogging of the toner.

Second iris member 63, which cooperates with first iris member 62 to complete the cover 9 for toner bottle 6, has concentrically spaced outer and inner walls 82, 83 respectively. The space between walls 82, 83 is bridged by a horizontal wall section 85 having a pair of diametrically opposed curved control slots 86 therein. The portion of inner wall 82 opposite each slot 86 has a line-like protrubance or projection 89. Slots 86 receive tabs 78 of first iris member 62 therethrough on assembly of members 62, 63 together with projections 89 being received in and cooperating with locking recesses 79 in first iris member 62 to locate iris members 62, 63 relative to one another in an iris closed postion. The arcuate length of slots 86 is such as to limit movement between iris members 62, 63 to a predetermined distance substantially equal to the movement required to fully open and close iris 60.

The inside diameter of the outer wall 82 of second iris member 63 is sized to permit member 63 to fit tightly over the rim 52 of toner container 8 when cover 9 is assembled therewith. To retain cover 9 in place on toner container 8, the lower end of outer wall 82 is reduced in diameter to form a locking surface 84 which fits over and interlocks with the external locking surface 54 of container 8. The interior of wall 82 of second iris member 63 is provided with a pair of diametrically opposed inwardly facing line-like projections 87 which are adapted to fit within and interlock with slots 55 on the upper rim 52 of the toner container 8. A pair of diametrically opposed locking tabs 88 project upwardly from the rim of inner wall 83, tabs 88 being circumferentially offset from slots 86 so as not to overlap slots 86. Tabs 88 have a radially outwardly extending rim 90 which, as will appear, serves to lock toner supply bottle 6 to toner hopper 40 on opening of the toner discharge iris in cover 9.

Second iris member 63 has plural evenly spaced spoke-like elements or seals 92 radiating from a hub 94 and forming triangular shaped toner dispensing apertures 64' therebetween which when aligned with apertures 64 in member 62 form four triangular shaped openings for dispensing toner from container 8 into toner supply hopper 40. While four apertures 64, 64' are illustrated, the number and configuration of the iris apertures may be varied as will be understood.

Figure 1:
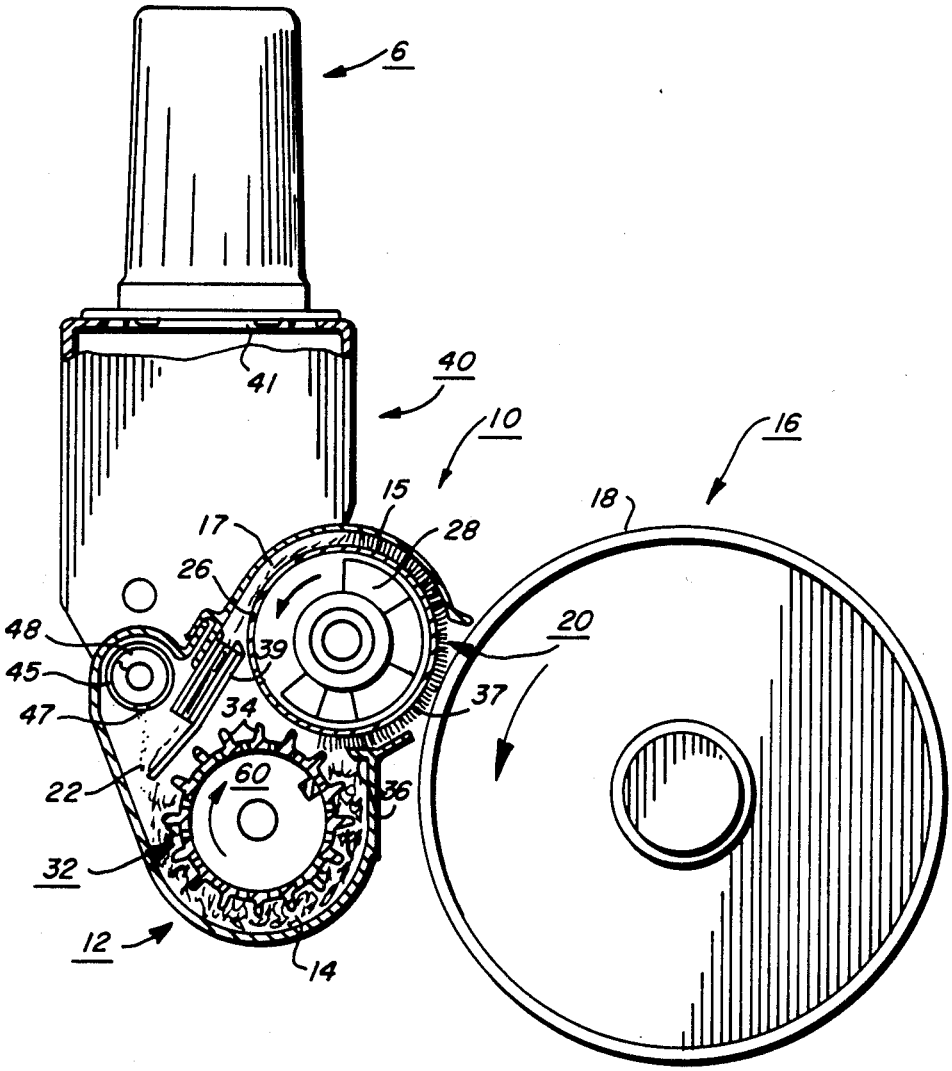
FIG. 1 is a side view partially in section showing details of an exemplary developing system for a reproduction or copying machine with the toner supply bottle of the present invention in a toner dispensing position.

Referring particularly to FIGS. 1 and 10, the diameter of toner access opening 41 of toner supply hopper 40 is substantially equal to or slightly less than the outside diameter of inner wall 83 of second iris member 63 to permit cover 9 of toner supply bottle 6 to be fitted tightly into opening 41 when it is desired to add fresh toner to hopper 40. Two pairs of diametrically opposed cutouts 91, 92 are provided in the wall 93 of opening 41, cutouts 91, 92 being sized and located to interlockingly receive tabs 78 of first iris member 62 and tabs 88 of second iris member 63 on insertion of bottle 6 into toner access opening 41. As will appear, cutouts 91, 92, which are stationary, cooperate with tabs 78, 88 to provide the requisite relative motion between iris members 62, 63 when bottle 6 is rotated to open and close the toner dispensing apertures 64, 64' in cover 9 and to lock bottle 6 to the toner hopper whenever the iris is open.

To close toner access opening 41 when bottle 6 is removed, a cylindrical plate-like cap 95 is provided, the outer diameter of cap 95 being substantially greater than the diameter of toner access opening 41 to assure closure of opening 41. Cap 95 is provided with a depending circular rim 96 having an outer diameter substantially equal to or slightly less than the inner diameter of toner access opening 41 so that when cap 95 is put in place, rim 96 fits tightly within opening 41 to seal opening 41. A pair of diametrically opposed radially outwardly projecting tabs 97 on rim 96 fit through cutouts 91 so that on subsequent rotation of cap 95, the cap is locked onto toner hopper 40 through interengagement of tabs 97 with the adjoining surfaces of the toner hopper 40.

OPERATION

Referring now to FIGS. 2–9 and 11, toner supply bottle 8 is initially filled with toner to a desired level. Normally, this would be done at the toner factory and in an assembly line operation. Before, during, or after this, iris members 62, 63 are assembled together by inserting tabs 78 of member 62 into the curved slots 86 of member 63 with the locking recesses 79 on tabs 78 aligned and interlocked with projections 89 on the inner wall 83 of member 63. As a result, iris members 62, 63 are disposed with seals 70, 92 thereof in bridging relationship. Accordingly, apertures 64, 64' are not aligned with one another and the iris in cover 9 is closed.

Cover 9 is placed over the open end of toner container 8 and oriented so that the opposed internal projections 87 on the outer wall 82 of member 63 are aligned with the locking slots 55 in the upper rim 52 of container 8. Cover 9 is forced down over the outer rim 57 of container 8 until the locking surface 84 of member 62 snaps over rim 52 of container 8 and into engagement with the external locking surface 54 thereof. At this point, the container 8 with toner therewithin is sealed by cover 9 and ready for distribution to customers.

When it is desired to add make-up toner to a toner supply hopper 40, cap 95 is removed from the toner access opening 41 by rotating the cap until tabs 97 are aligned with cutouts 91 permitting cap 95 to be removed and opening 41 exposed. Toner supply bottle 6 is inverted and the reduced end 83 of cover 9 inserted into the opening 41. To do this, bottle 6 is oriented so that the tabs 78, 88 on bottle 6 are aligned with cutouts 91, 92 respectively along the side of opening 41. On insertion, the bottom or container portion 8 of bottle 6 is grasped and manually rotated (i.e. in a clockwise direction) forcing the radially outwardly extending rims 90 of tabs 88 past cutouts 92 and into overlapping relation with the surfaces of the toner hopper 40 adjoining opening 41. This locks bottle 6 to toner hopper 40 preventing removal of the bottle and possible spilling of the toner through the opened or partially opened iris.

Concurrently, the interlocking engagement of tabs 78 with cutouts 92 holds first iris member 62 against rotation while the toner container 8 and second iris member 63 move in unison, the latter through the interlocking engagement of locking slots 55 of container 8 with projections 87 of member 63. The relative movement between iris members 62, 63 opens the iris, such movement continuing until toner dispensing apertures 64, 64' are in alignment with one another as determined by the abutment of tabs 78 against the opposite end of slots 86.

Following dispensing of the toner supply from container 8, the aforedescribed process is reversed, rotation of bottle 6 in the opposite direction closing the iris and bringing tabs 88 into alignment with cutouts 91 permitting the removal of toner supply bottle 6 which is presumably empty. Cap 95 is then secured in place to seal the toner access opening 41.

While the invention has been described with reference to the structure disclosed, it is not confined to the details set forth, but is intended to cover such modifications or changes as may come within the scope of the following claims.

I claim:

1. A toner bottle of the type which fits over the toner inlet in the developer housing of a copier/printing machine to add toner to said machine without spilling or loss, comprising, in combination:

(a) a container for said toner, said container having a toner discharge opening at one end; and (b) a cover for said container one end, said cover including (1) a first iris member having at least one aperture therethrough for assembly with said container so as to close said container toner discharge opening except for said aperture, said first iris member having at least one control tab projecting outwardly therefrom; and (2) a second iris member having an aperture therethrough corresponding to each aperture in said first iris member, said first and second iris members cooperating with one another to form an iris adapted on predetermined relative rotation between said first and second iris members to align the aperture in said first iris member with the corresponding aperture in said second iris member to enable toner to discharge through said apertures from said container, said apertures when not aligned closing said container toner discharge opening;

said second iris member being sized to fit over said container one end to trap said first iris member therebetween and form said cover with said iris;

said second iris member having a slot for each of said first iris member control tabs, said slot having a predetermined length whereby to limit relative movement between said first and second iris members and establish open and closed positions of said iris;

said second iris member having at least one outwardly projecting locking tab;

whereby on assembly of said bottle with said housing and rotation of said bottle, said second iris member locking tab is moved into locking engagement with said developer housing to attach said bottle to said developer housing while said first iris member control tab is locked against movement to establish relative movement between said first and second iris members through a distance established by the predetermined length of said slot to bring the apertures in said first and second iris members into alignment with one another and discharge toner from said container into said developer housing.

2. The bottle according to claim 1 in which said first iris member includes generally triangular passages leading from said container interior to said first iris member aperture to facilitate the flow of toner from said container on opening of said aperture without clogging.

3. The bottle according to claim 1 including means to pre-locate said first and second iris members so that said iris is closed on assembly of said first and second iris members with one another and said container.

4. The bottle according to claim 1 including a least one groove or projection on said container with mating projection or groove on said second iris member for coupling said second iris member with said container for joint movement on assembly of said cover with said container.

5. A toner bottle of the type which fits over the toner inlet in the developer housing of a copier/printing machine to add toner to said machine without spilling or loss, comprising, in combination:

(a) a generally cylindrical container for said toner, said container having a toner discharge opening at one end; and (b) a cover for said container one end, said cover including (1) a first iris member having at least one aperture therethrough for assembly with said container so as to close said container toner discharge opening except for said aperture, said first iris member having at least one control tab projecting outwardly therefrom;

the diameter of said container adjacent said toner access opening being larger than the diameter of the remainder of said container, the difference in diameters between said container toner discharge opening and the remainder of said container forming an internal annular rim for supporting said first iris member on assembly of said first iris member with said container;

(2) a second iris member having an aperture therethrough corresponding to each aperture in said first iris member, said first and second iris members cooperating with one another to form an iris adapted on predetermined relative rotation between said first and second iris members to align the aperture in said first iris member with the corresponding aperture in said second iris member to enable toner to discharge through said apertures from said container, said apertures when not aligned closing said container toner discharge opening;

said second iris member being sized to fit over said container one end to trap said first iris member therebetween and form said cover with said iris;

said second iris member having a slot for each of said first iris member control tabs, said slot having a predetermined length whereby to limit relative movement between said first and second iris members and establish open and closed positions of said iris;

said second iris member having at least one outwardly projecting locking tab;

whereby on assembly of said bottle with said housing and rotation of said bottle, said second iris member locking tab is moved into locking engagement with said developer housing to attach said bottle to said developer housing while said first iris member control tab is locked against movement to establish relative movement between said first and second iris members through a distance established by the predetermined length of said slot to bring the apertures in said first and second iris members into alignment with one another and discharge toner from said container into said developer housing.

6. A toner bottle of the type which fits over the toner inlet in the developer housing of a copier/printing machine to add toner to said machine without spilling or loss, comprising, in combination:

(a) a container for said toner, said container having a toner discharge opening at one end; and (b) a cover for said container one end, said cover including (1) a first iris member having at least one aperture therethrough for assembly with said container so as to close said container toner discharge opening except for said aperture, said first iris member having at least one control tab projecting outwardly therefrom; and (2) a second iris member having an aperture therethrough corresponding to each aperture in said first iris member, said first and second iris members cooperating with one another to form an iris adapted on predetermined relative rotation between said first and second iris members to align the aperture in said first iris member with the corresponding aperture in said second iris member to enable toner to discharge through said apertures from said container, said apertures when not aligned closing said container toner discharge opening;

said second iris member being sized to fit over said container one end to trap said first iris member therebetween and form said cover with said iris;

said second iris member has inner and outer annular walls interconnected to one another by a ring-like surface, said slot being provided in said surface said second iris member having a slot for each of said first iris member control tabs, said slot having a predetermined length whereby to limit relative movement between said first and second iris members and establish open and closed positions of said iris;

said second iris member has inner and outer annular walls interconnected to one another by a ring-like surface, said slot being provided in said surface, said second iris member having at least one outwardly projecting locking tab;

whereby on assembly of said bottle with said housing and rotation of said bottle, said second iris member locking tab is moved into locking engagement with said developer housing to attach said bottle to said developer housing while said first iris member control tab is locked against movement to establish relative movement between said first and second iris members through a distance established by the predetermined length of said slot to bring the apertures in said first and second iris members into alignment with one another and discharge toner from said container into said developer housing.

7. A toner bottle of the type which fits over the toner inlet in the developer housing of a copier/printing machine to add toner to said machine without spilling or loss, comprising, in combination:

(a) a container for said toner, said container having a toner discharge opening at one end;

(b) a cover for said container one end, said cover including (1) a first iris member having at least one aperture therethrough for assembly with said container so as to close said container toner discharge opening except for said aperture, said first iris member having at least one control tab projecting outwardly thereform; and (2) a second iris member having an aperture therethrough corresponding to each aperture in said first iris member, said first and second iris members cooperating with one another to form an iris adapted on predetermined relative rotation between said first and second iris members to align the aperture in said first iris member with the corresponding aperture in said second iris member to enable toner to discharge through said apertures from said container, said apertures when not aligned closing said container toner discharge opening;

said second iris member being sized to fit over said container one end to trap said first iris member therebetween and form said cover with said iris;

said second iris member having a slot for each of said first iris member control tabs, said slot having a predetermined length whereby to limit relative movement between said first and second iris members and establish open and closed positions of said iris;

said second iris member having at least one outwardly projecting locking tab; and means to pre-locate said first and second iris members so that said iris is closed on assembly of said first and second iris members with one another and said container, said means comprising a groove or projection on said control tab with mating projection or groove on said second iris member, whereby on assembly of said bottle with said housing and rotation of said bottle, said second iris member locking tab is moved into locking engagement with said developer housing to attach said bottle to said developer housing while said first iris member control tab is locked against movement to establish relative movement between said first and second iris members through a distance established by the predetermined length of said slot to bring the apertures in said first and second iris members into alignment with one another and discharge toner from said container into said developer housing.

* * * * *